US007174657B2

(12) United States Patent
Berg et al.

(10) Patent No.: US 7,174,657 B2
(45) Date of Patent: Feb. 13, 2007

(54) SHOE WITH INTERCHANGEABLE STRAP SYSTEM

(76) Inventors: David Berg, 218 Dumaire, White Lake, MI (US) 48383; Thomas E. McGann, III, 2349 Ethel, Walled Lake, MI (US) 48390

( * ) Notice: Subject to any disclaimer, the term of this patent is extended or adjusted under 35 U.S.C. 154(b) by 0 days.

(21) Appl. No.: 11/231,611

(22) Filed: Sep. 21, 2005

(65) Prior Publication Data

US 2006/0026779 A1 Feb. 9, 2006

Related U.S. Application Data

(63) Continuation of application No. 10/911,069, filed on Aug. 4, 2004, which is a continuation-in-part of application No. 10/011,117, filed on Nov. 13, 2001, now Pat. No. 6,792,696.

(60) Provisional application No. 60/248,167, filed on Nov. 13, 2000.

(51) Int. Cl.
*A43B 3/12* (2006.01)

(52) U.S. Cl. ..... 36/11.5; 36/101

(58) Field of Classification Search ..... 36/101, 36/100, 11.5

See application file for complete search history.

(56) References Cited

U.S. PATENT DOCUMENTS

| | | | | |
|---|---|---|---|---|
| 2,253,860 | A | | 8/1941 | Martin |
| 2,343,701 | A | | 3/1944 | Pickens |
| 2,491,297 | A | | 12/1949 | Brown |
| 2,495,984 | A | | 1/1950 | Roy |
| 2,526,940 | A | * | 10/1950 | Fello ..... 36/11.5 |
| 2,590,648 | A | | 3/1952 | Pitz |
| 2,607,133 | A | | 8/1952 | Marlowe |
| 2,873,540 | A | | 2/1959 | Murphy |
| 3,228,124 | A | | 1/1966 | Schwartz |
| 3,455,037 | A | | 7/1969 | Vlas et al. |
| 3,983,642 | A | | 10/1976 | Liao |
| 4,114,295 | A | | 9/1978 | Schaefer |
| 4,114,296 | A | | 9/1978 | Smith |
| 4,172,330 | A | | 10/1979 | Kao |
| 4,193,214 | A | | 3/1980 | Wang |

(Continued)

FOREIGN PATENT DOCUMENTS

GB 2 071 481 A 9/1981

(Continued)

*Primary Examiner*—Ted Kavanaugh
(74) *Attorney, Agent, or Firm*—Gifford, Krass, Groh, Sprinkle, Anderson & Citkowski, P.C.

(57) ABSTRACT

The present invention provides improved footwear that overcomes many of the limitations of the prior art. A shoe according to the present invention, includes a sole member with an upper surface for receiving a user's foot and a lower surface for contacting a support surface. The sole member has a first sidewall and a second sidewall that are spaced apart and extend between the upper and lower surfaces. The sole member also has a slot defined therethrough, with the slot extending between the first and second sidewalls. A strap has a pair of opposed ends and a midportion therebetween. The midportion is designed to be received in and retained by the slot. The slot also has a closure member for joining the opposed ends. When the midportion of the strap is received in the slot and the closure member joins the opposed ends, the strap and the sole cooperate to form a shoe upper for receiving the foot.

5 Claims, 14 Drawing Sheets

U.S. PATENT DOCUMENTS

| | | | |
|---|---|---|---|
| 4,267,649 | A | 5/1981 | Smith |
| 4,279,083 | A | 7/1981 | Dilg |
| 4,297,798 | A | 11/1981 | Colan |
| 4,300,294 | A | 11/1981 | Riecken |
| 4,314,412 | A | 2/1982 | Anderson et al. |
| 4,343,057 | A | 8/1982 | Bensley |
| 4,348,820 | A | 9/1982 | D'Alessio |
| 4,363,177 | A | 12/1982 | Boros |
| 4,370,818 | A | 2/1983 | Simoglou |
| 4,439,935 | A | 4/1984 | Kelly |
| 4,450,633 | A | 5/1984 | Connelly |
| 4,461,102 | A | 7/1984 | DeVincentis |
| 4,497,123 | A | 2/1985 | Ehrlich |
| 4,563,787 | A | 1/1986 | Drew |
| 4,745,693 | A | 5/1988 | Brown |
| 4,854,056 | A | 8/1989 | Levin |
| 4,869,000 | A | 9/1989 | York, Jr. |
| 4,887,369 | A | 12/1989 | Bailey et al. |
| 4,967,750 | A | 11/1990 | Cherniak |
| 5,052,131 | A | 10/1991 | Rondini |
| 5,065,531 | A | 11/1991 | Prestridge |
| 5,381,610 | A | 1/1995 | Hanson |
| 5,410,821 | A | 5/1995 | Hilgendorf |
| 5,423,134 | A | 6/1995 | Bagnaia et al. |
| 5,459,948 | A | 10/1995 | Aveni |
| 5,477,625 | A | 12/1995 | Goldsmith et al. |
| 5,483,757 | A | 1/1996 | Ferykberg |
| 5,611,156 | A | 3/1997 | Chiu |
| 5,692,322 | A | 12/1997 | Lombardino |
| 5,778,565 | A | 7/1998 | Holt et al. |
| 5,802,738 | A | 9/1998 | Ferniani |
| 5,836,090 | A | 11/1998 | Smith |
| 5,848,484 | A | 12/1998 | Dupree et al. |
| 5,852,885 | A | 12/1998 | Ferniani |
| 5,896,684 | A | 4/1999 | Lin |
| 5,946,823 | A | 9/1999 | Yates |
| 6,035,554 | A | 3/2000 | Duncan |
| 6,128,834 | A | 10/2000 | Vecchiola et al. |
| 6,282,818 | B1 | 9/2001 | Lu |
| 6,792,696 | B2 * | 9/2004 | Berg et al. ..... 36/11.5 |

FOREIGN PATENT DOCUMENTS

| | | | |
|---|---|---|---|
| GB | 2 167 592 | A | 5/1986 |

* cited by examiner

FIG - 49
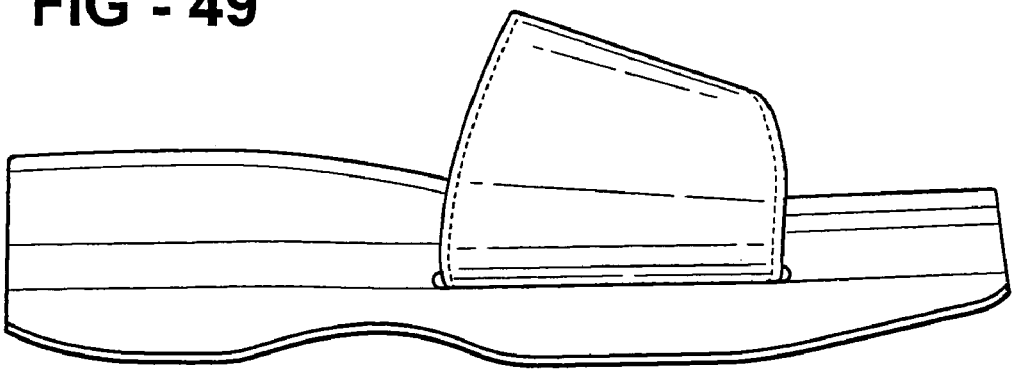
FIG - 50
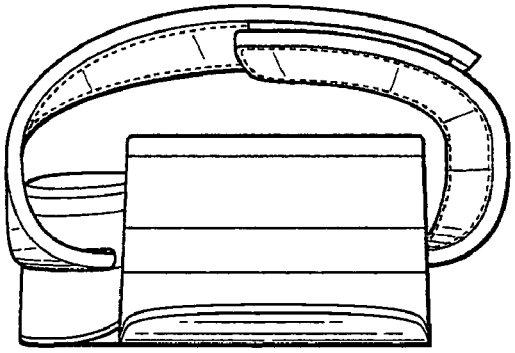
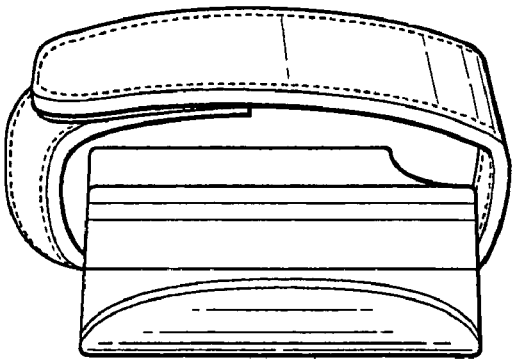
FIG - 51

SHOE WITH INTERCHANGEABLE STRAP SYSTEM

REFERENCE TO RELATED APPLICATION

This application is a continuation of U.S. patent application Ser. No. 10/911,069, filed Aug. 4, 2004 still pending, which is a continuation-in-part of U.S. patent application Ser. No. 10/011,117, filed Nov. 13, 2001 now U.S. Pat. No. 6,792,696, which claims priority from U.S. provisional patent application Ser. No. 60/248,167, filed Nov. 13, 2000, the entire contents of each application are incorporated herein by reference.

FIELD OF THE INVENTION

The present invention relates generally to footwear and, more specifically, to a shoe with an interchangeable strap to allow aesthetic and functional changes to the shoe.

BACKGROUND OF THE INVENTION

Footwear comes in an enormous variety of styles and designs to suit numerous functional and aesthetic goals. Fashion conscious consumers often wish to coordinate their footwear with the remainder of their attire. For example, some consumers may wish to own several pairs of very similar shoes in a variety of colors so as to color-coordinate with a variety of outfits. However, this may require the purchase of a large number of pairs of shoes, sandals, boots, and other footwear. This presents both a financial burden and difficulty in storing the footwear. In light of this, there is a need for footwear that allows easy coordination with a variety of clothing.

There have been a number of attempts to provide footwear that has changeable portions to allow alterations in the appearance and/or function of the footwear. U.S. Pat. No. 2,495,984 to Roy provides a flat sole with laces that may be used to tie a removable upper thereto. Two slots are provided in the sole, one under the toes and one under the heel. The upper also has snaps that allow it to snap to the sole to hold it in place. This design is complicated, the laces do not reliably locate the foot or define the upper, and snaps are required to locate the upper.

U.S. Pat. No. 2,491,297 to Brown provides a piece of footwear having a sole with a slot through the sole position just forward of the heel and an upper that may be tied on with the lace in cooperation with an attachment eyelet extending upwardly between the toes of the user. Again, this is a complicated design. Also, the lace that ties the upper on does not define an upper and can only operate in cooperation with the between-the-toes eyelet.

U.S. Pat. No. 4,172,330 to Kao discloses a "flip-flop" or thong-like sandal wherein the upper straps are detachable from the sole. Vertical holes pass from the upper surface of the sole to the lower surface and the ends of the strap engage these holes. This design does not provide for reliable attachment between the straps and the lower, the straps require a complicated design, an attachment is forced between the user's toes, and the straps may not be easily interchanged.

U.S. Pat. No. 5,836,090 to Smith provides a sandal with the sole having upperwardly extending flanges with openings to receive laces. Again, this is a complicated design. Several designs have been proposed wherein a detachable upper connects to a sole using snaps or other fasteners on the sides of the soles. A representative example is U.S. Pat. No. 4,461,102 to DeVincentis. These designs are typically complicated and provide a non-aesthetic appearance.

None of the various approaches has caught on as they have been overly complicated, functioned poorly, and/or were too expensive. Therefore, there remains a need for simple footwear that allows changes in appearance.

SUMMARY OF THE INVENTION

The present invention provides improved footwear that overcomes many of the limitations of the prior art. A shoe according to the present invention, includes a sole member with an upper surface for receiving a user's foot and a lower surface for contacting a support surface. The sole member has a first sidewall and a second sidewall that are spaced apart and extend between the upper and lower surfaces. The sole member also has a slot defined therethrough, with the slot extending between the first and second sidewalls. A strap has a pair of opposed ends and a midportion therebetween. The midportion is designed to be received in and retained by the slot. The slot also has a closure member for joining the opposed ends. When the midportion of the strap is received in the slot and the closure member joins the opposed ends, the strap and the sole cooperate to form a shoe upper for receiving the foot.

BRIEF DESCRIPTION OF THE DRAWINGS

FIG. 49 is an opposite side view of the shoe of FIG. 46;

FIG. 50 is a rear view of the shoe of FIG. 46; and

FIG. 51 is a front view of the shoe of FIG. 46.

DETAILED DESCRIPTION OF THE PREFERRED EMBODIMENTS

Figure 1:
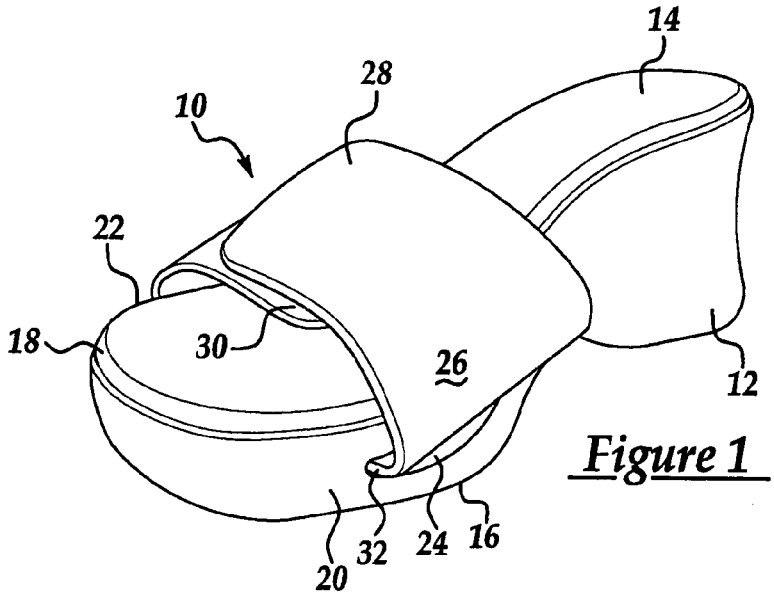
FIG. 1 is a perspective view of an embodiment of a shoe according to the present invention with the opposed ends of an interchangeable strap interconnected to form the shoe's upper.

Referring to FIG. 1, one embodiment of a shoe according to the present invention is generally shown at 10. The shoe includes a sole member 12 with an upper surface 14 and a lower surface 16. In use, a user's foot is placed on the upper surface 14 and the lower surface 16 contacts a support surface, such as a floor or the ground. In some embodiments, the upper surface 14 is formed of a different material than the remainder of the sole member 12. In the illustrated embodiment, the upper surface includes a padded sock liner 18.

The sole member 12 may be said to have a pair of sidewalls 20 and 22 that extend between the upper surface 14 and lower surface 16 and are spaced apart from one another. Alternatively, the sidewalls 20 and 22 may be considered to be part of the same perimeter wall that determines the shape of the sole member in plan view. A slot 24 is defined through the sole member 12 and extends between the sidewalls 20 and 22. While the sidewalls 20 and 22 are shown as being generally straight or flat, they may alternatively have different shapes. For example, the sidewalls may be concave or convex.

A strap or strap member 26 is shown cooperating with the sole member 12 to define an upper for the shoe 10. The strap may be said to have a pair of opposed ends 28 and 30 with a mid-portion between the opposed ends. As illustrated, when the sole member 12 and strap 26 are assembled, the mid-portion 32 of the strap is disposed in the slot 24 and the opposed ends 28 and 30 of the strap 26 are joined by a closure member. In the illustrated embodiment, the closure member is portions of hook and loop-type fastening material disposed on the ends 28 and 30 so that the ends may be joined. With the ends joined, the strap forms a loop extending from the sole member 12 for receiving the user's foot. In the illustrated embodiment, the closure member and the opposed ends are generally positioned directly above the upper surface of the sole member and equally distant from the sidewalls. Alternatively, the ends and the closure member may be positioned in the slot or more towards one or the other sides of the shoe.

Figure 2:
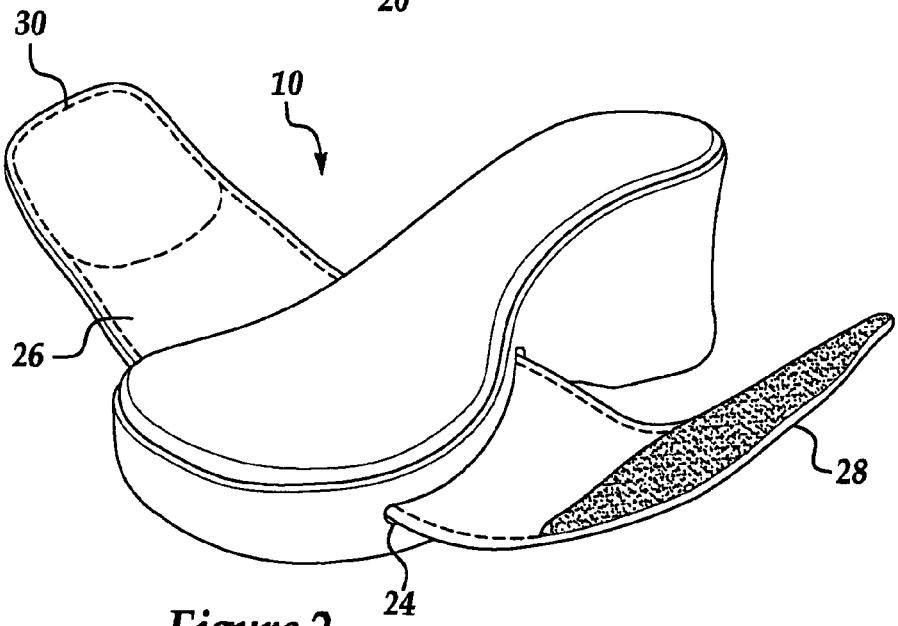
FIG. 2 is a perspective view of the shoe of FIG. 1 with the opposed ends of the strap released from one another.
Figure 3:
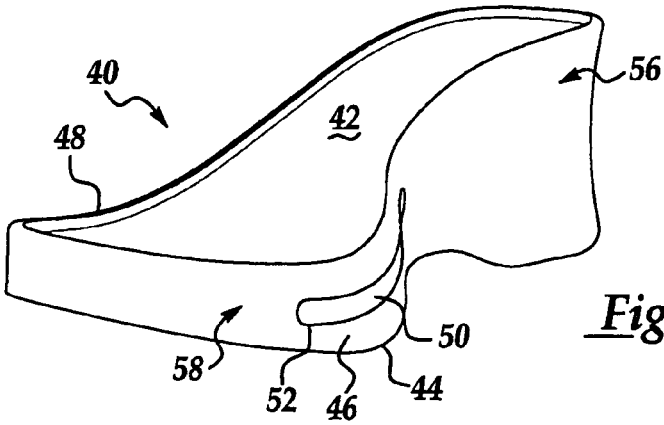
FIG. 3 is a perspective view of a first embodiment of a shoe sole for use with the present invention.
Figure 4:
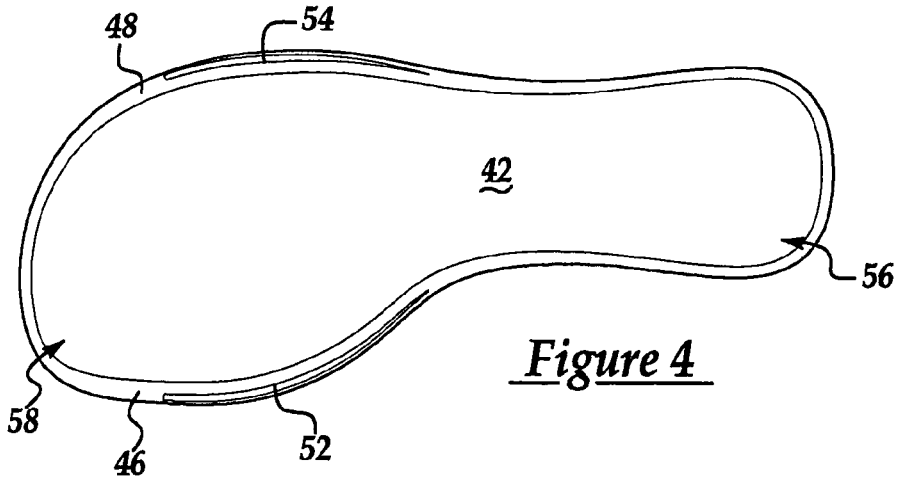
FIG. 4 is a top plan view of the shoe sole of FIG. 3.
Figure 5:
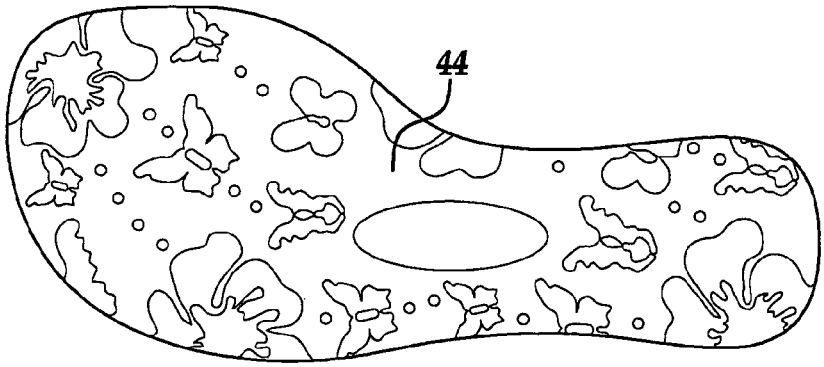
FIG. 5 is a bottom plan view of the shoe sole of FIG. 3.

Referring now to FIG. 2, the shoe 10 is shown with the strap 26 having its opposed ends 28 and 30 separated. Once the ends are separated, the strap 26 may be removed from the slot 24. A different strap may then be substituted so as to alter the aesthetic appearance or fit of the shoe 10.

The general concept of the present invention is directed to the provision of a shoe sole with a side-to-side slot for receiving a removable strap, with the strap having ends that may be joined so as to form a shoe upper. The embodiment illustrated in FIGS. 1 and 2 is merely representative of one possible configuration for a shoe according to the present invention. Numerous alternative versions also fall within the scope of the present invention. Different shoe designs which fall within the scope of the present invention will differ in certain details of their construction, but will include the common elements discussed above. Hereinbelow, specific embodiments of the present invention will be discussed in extensive detail. However, some or all of these details may apply only to the illustrated embodiments and be less applicable to other variations that fall within the scope of the present invention. It should be noted that throughout this application, shoe soles and straps have been illustrated only for one shoe out of a pair. As will be clear to those of skill in the shoe art, shoes are provided in pairs, including a right shoe and a left shoe, which are essentially mirror images of one another. By illustrating only a right or a left shoe, shoe sole, or strap, the present invention enables the construction and use of a right and a left shoe.

According to a preferred embodiment of the present invention, a variety of styles of shoe soles may be provided, along with straps having a variety of appearances. The various shoe sole designs may receive different strap designs so as to alter their appearance and/or fit. Likewise, some strap designs may be used with more than one shoe sole design. This interchangeability of straps and/or soles allows great flexibility in the use of the present invention.

Referring now to FIGS. 3–8, a high heeled embodiment of a shoe sole according to the present invention is generally illustrated at 40. The shoe sole 40 has an upper surface 42 and a lower surface 44. A pair of sidewalls 46 and 48 extend between the upper surface 42 and the lower surface 44. A slot 50 extends between the sidewalls 46 and 48 such that it passes side-to-side through the shoe sole 40. The slot 50 is defined between an opening 52 in the sidewall 46 and an opening 54 in the sidewall 48. In a preferred embodiment, a slot has a generally constant cross section between the openings 52 and 54. Alternatively, a slot may have other configurations. For example, the shoe sole 40 could be hollow between the sidewalls 46 and 48, with the slot 50 being defined only by the openings 52 and 54.

Figure 6:
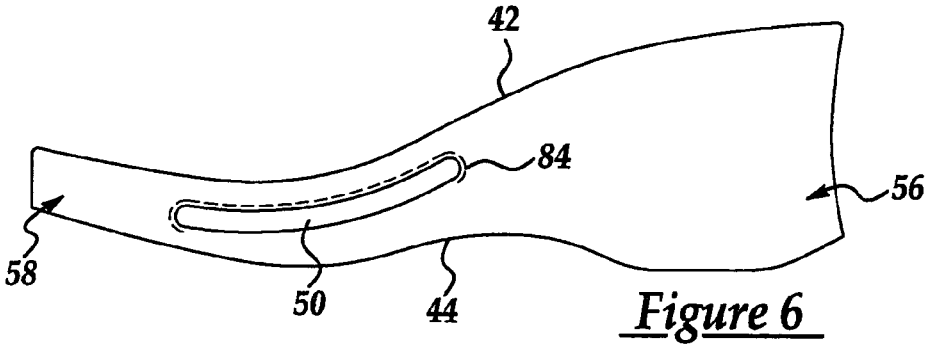
FIG. 6 is a side elevational view of the shoe sole of FIG. 3, the opposite side being a mirror image thereof.
Figure 7:
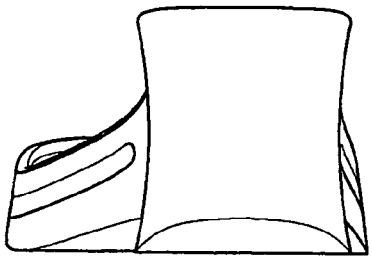
FIG. 7 is a rear elevational view of the shoe sole of FIG. 3.
Figure 8:
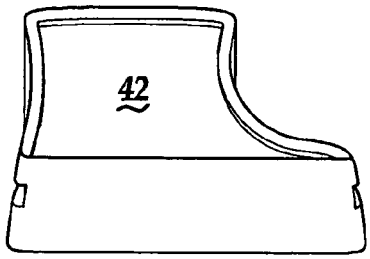
FIG. 8 is a front elevational view of the shoe sole of FIG. 3.
Figure 9:
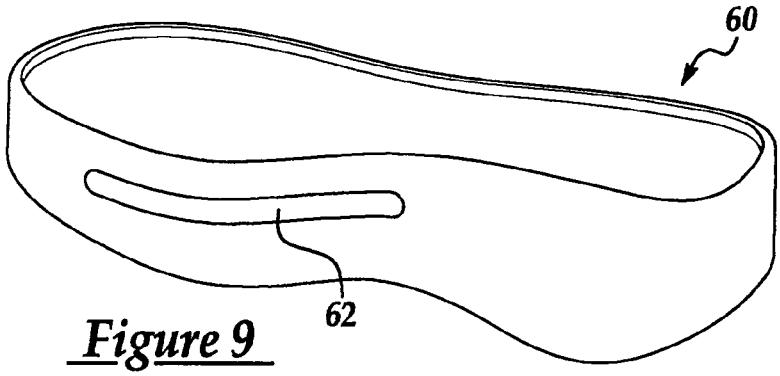
FIG. 9 is a perspective view of a second embodiment of a shoe sole for use with the present invention.
Figure 10:
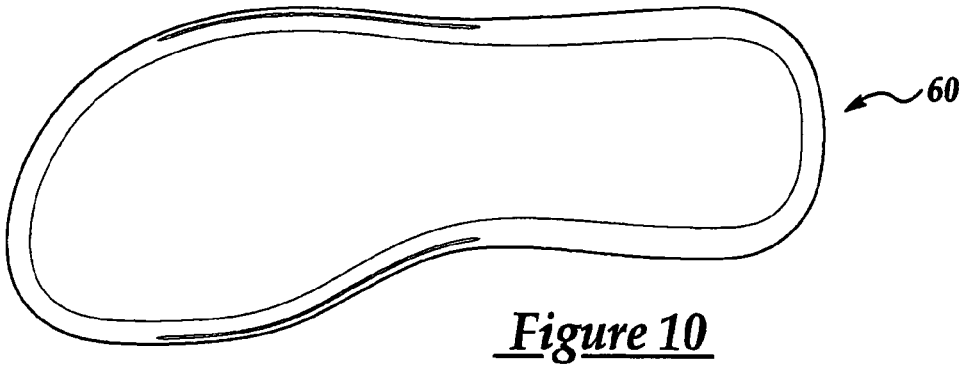
FIG. 10 is a top plan view of the shoe sole of FIG. 9.
Figure 11:
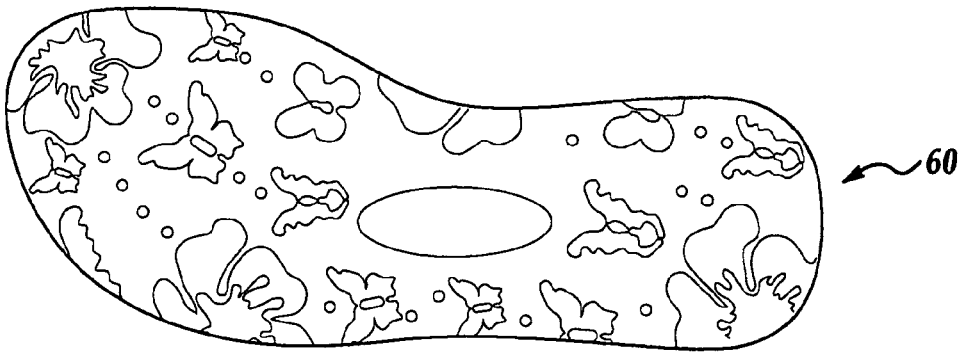
FIG. 11 is a bottom plan view of the shoe sole of FIG. 9.
Figure 12:
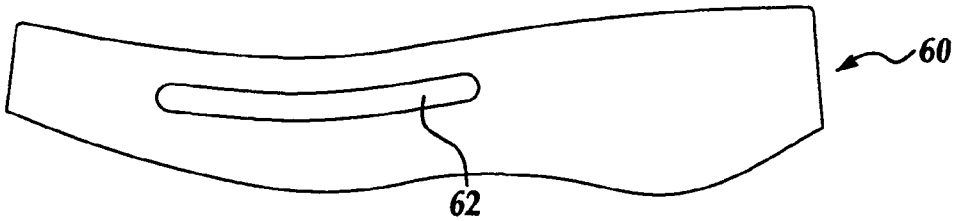
FIG. 12 is a side elevational view of the shoe sole of FIG. 9, the opposite side being a mirror image thereof.
Figure 13:
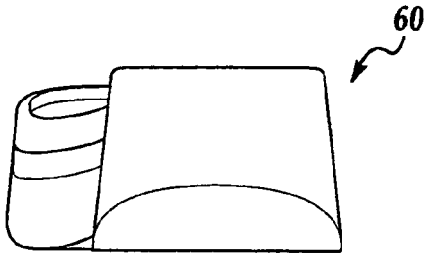
FIG. 13 is a rear elevational view of the shoe sole of FIG. 9.
Figure 14:
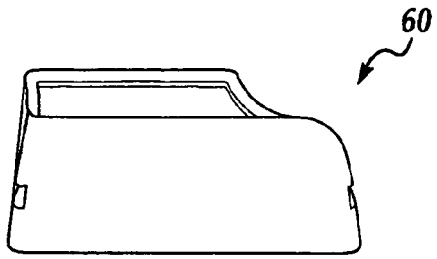
FIG. 14 is a front elevational view of the shoe sole of FIG. 9.

The shoe sole 40 may be said to have a heel portion 56 towards the rear of the shoe and a forefoot portion 58 towards the front of the shoe. Because this is a high heel version of a shoe sole, the upper surface 42 of the heel portion 56 is higher than the upper surface 42 of the forefoot portion 58. Preferably, the upper surface 42 is not flat, but is instead curved so as to comfortably fit a foot. The shape of the upper surface is sometimes referred to as the top line of the shoe. As best seen in FIG. 6, the top line of the shoe slopes most steeply between the forefoot portion 58 and the heel portion 56, with the rearwardmost portion and the forwardmost portion being more level. In fact, the forwardmost portion of the upper surface of the forefoot portion 58 may slope in the opposite direction in order to provide a dished area to receive the ball of the foot. Preferably, the slot 50 is contoured so as to be generally parallel to the top line or upper surface 42 of the shoe sole 40.

Referring now to FIGS. 9–14, an alternative mid-heel version of a shoe sole is illustrated generally at 60. The shoe sole 60 differs from the shoe sole 40 in that the heel portion is lower with respect to the forefoot portion. Certain aspects of the shape of the shoe sole 60 may also be altered in changing from a high heel to a mid-heel in order to more comfortably fit a foot, as will be clear to those with skill in the shoe art. Otherwise, the shoe sole 60 is similar to the shoe sole 40 and includes a side-to-side slot 62 defined through the shoe sole 60.

Figure 15:
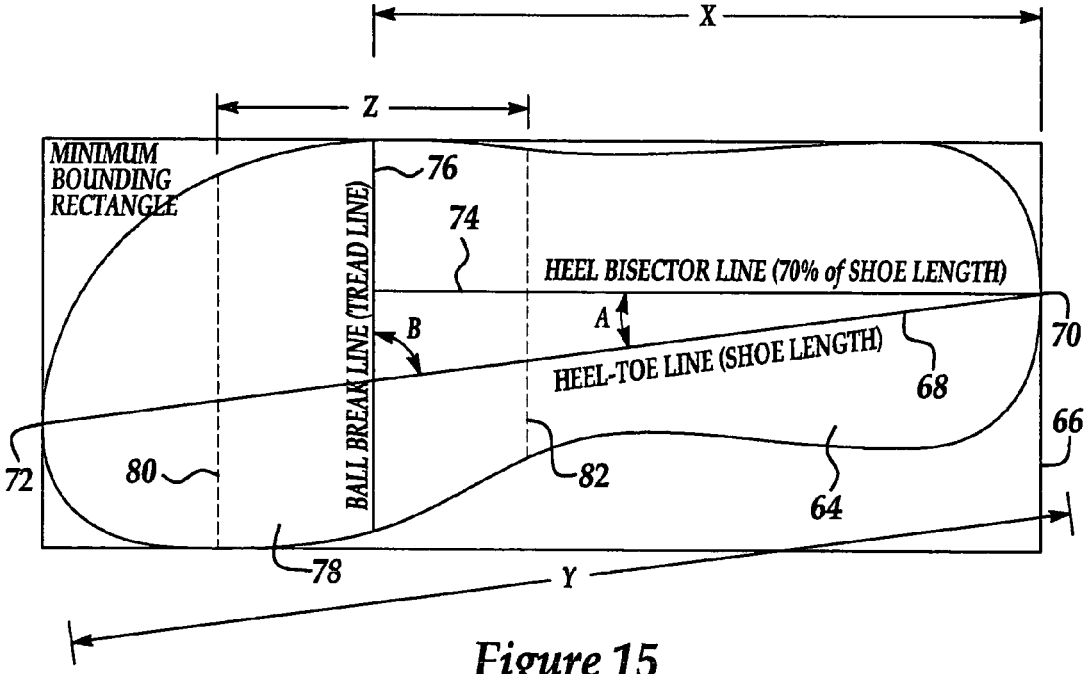
FIG. 15 is a schematic representation of a shoe sole for use with the present invention, indicating reference lines and regions for use in describing the construction of the shoe sole.

Referring now to FIG. 15, a shoe sole 64 is shown schematically in plan view with various reference lines illustrated. The shoe sole 64 is drawn inside of a minimum bounding rectangle 66. Generally, a minimum bounding rectangle is the smallest rectangle into which a complex shape, such as the outline of the shoe sole 64, will fit. A heel-toe line 68 may be defined as extending between a point 70 where the minimum bounding rectangle 66 touches the rear of the heel and a point 72 where the minimum bounding rectangle 66 intersects the front of the toe of the shoe sole 64. A heel bisector line 74 may be defined from the point 70 where the minimum bounding rectangle 66 intersects the rear end of the heel of the sole 64 and extending forwardly at a position equidistant from either side of the heel area. The heel bisector line is illustrated as having a length X equal to 70 percent of the length Y of the heel-toe line (the length of the sole). A ball break line 76 is defined as a line perpendicular to the heel bisector line that is spaced from the rear of the shoe sole 64 by the distance X (equal to 70 percent of the length Y of the heel-toe line). The length of the heel-toe line 68 is also defined as the shoe length. The ball break line 76 is designed to fall under a user's foot where the foot naturally flexes under the ball. As illustrated in FIG. 15, the slot 78 preferably extends side-to-side through the shoe sole and generally straddles the ball break line 76. Preferably, the slot is positioned such that approximately half of the slot is ahead of the ball break line and half of the slot is behind the ball break line. Likewise, when a strap is positioned with its mid-portion positioned in the slot, the strap is then positioned so as to straddle the ball break line with about half of the strap ahead of the line and half of the strap behind the line. Also as illustrated, the slot 78 is preferably generally parallel to the ball break line 76. That is, the slot 78 may be designed as having a front edge 80 and a rear edge 82 that are both generally parallel to the ball break line 76. As illustrated, the ball break line and the slot are therefore generally angled with respect to the heel-toe line 68. In the illustrated embodiment, the inside angle A between the heel bisector line 74 and the heel-toe line 68 is approximately 5 degrees and the inside angle B between the heel-toe line 68 and the ball break line 76 is approximately 85 degrees. However, other angles, such as angle A being in the range of 0–10 degrees and angle B being in the range of 80–90 degrees may be used, as well as larger and smaller angles.

A ball break line may also be defined with respect to a human foot. In this case, the ball break line is the line of flexure at the ball of the foot. Preferably, the ball break line of the sole and the ball break line of the foot are generally aligned. Therefore, a slot and strap positioned as described straddles the ball break line of the foot. This positioning allows a strap to reliably retain the shoe on a user's foot without the need for other shoe upper elements. The fact that the strap may be relatively wide additionally assists in the retention of the shoe. It is preferred that the strap have a width greater than one inch in the midportion, with greater than two inches being even more preferred.

As will be clear to those with skill in the shoe art, shoe lengths and widths vary depending on shoe size and shoe style. The shoe soles illustrated in FIGS. 3–14 are generally representative of a medium width women's size 6 shoe sole. This shoe sole has a shoe length, as defined by the heel-toe line, of approximately 9⅛ of an inch and a width, at the ball break line, of approximately 3¾ of an inch. The front to rear width of the slot in a shoe sole according to the present invention may vary depending on the style and function of the shoe. In the illustrated embodiment, the slot has a front to rear length (Z in FIG. 15) of approximately three inches.

Generally, the length of a woman's shoe increases approximately ⅓ of an inch with each whole size. Additionally, the width of the shoe increases approximately 1/12 of an inch with each whole size. In shoes that are offered in various widths, the width of the shoe changes approximately 1/16 of an inch between width sizes. According to one design approach for shoes according to the present invention, the slot length is the same for all adult women's sizes. This allows the use of straps with the same front-to-back width to be used with more than one size of shoe. As an alternative approach, slot length Z may vary with shoe size either continuously, or in discreet steps. As one example, three different slot lengths may be used for shoes in the adult range. In the illustrated embodiments, the slots have a front-to-rear length Z of approximately three inches. Also as illustrated, the slots preferably have front and rear edges that are parallel to one another such that the slot has a constant length as it passes through the shoe sole. This allows a strap to be positioned in the slot from either side of the slot. Alternatively, the slot could be angled.

Referring again to FIGS. 3 and 6, the slot 50 may have a height of approximately 6 mm for a women's size 6 medium width shoe. As illustrated, the slot 50 may have a constant height, front to rear. The slot 50 may be separated by various distances from the upper surface 42. In the illustrated embodiment, the slot 50 is separated from the upper surface 42 by approximately 8 mm. This distance may vary depending on the design and style of the shoe. Also, in some embodiments, the slot 50 may not be parallel to the upper surface 42.

When in use, the strap exerts significant force on the shoe sole. Preferably, a reinforcement 84 is provided in the shoe sole so as to reinforce the slot 50, especially at its front and rear edges and along its upper side. In some embodiments, the reinforcement 84 is provided by a reinforcing cloth insert in the shoe sole. In one preferred embodiment, the reinforcement material is a woven material. Some preferred materials for the shoe sole include thermoplastic urethane and EVA. The material may be single or multiple density. With the molded plastic materials, a slot reinforcing material, such as 84 in FIG. 6, is preferred. The shoe sole could also be made out of a material that is tougher and therefore does not require reinforcement. More rigid materials, such as wood or hard plastic may also be used.

Figure 16:
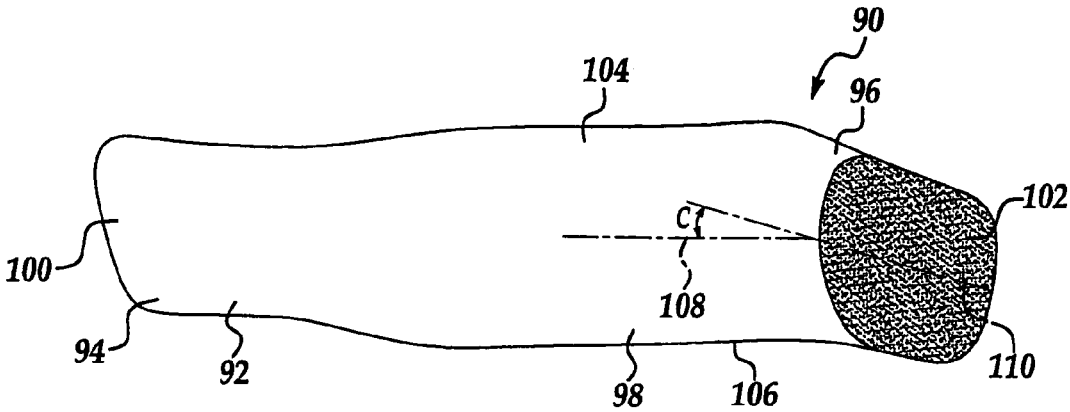
FIG. 16 is a top plan view of a first embodiment of a strap for use with one of the shoe soles of FIGS. 3–14 according to the present invention.

Referring now to FIGS. 16–20, a strap for use with the shoe soles shown in FIGS. 3–14 will be described in more detail. FIG. 16 shows a strap 90 removed from a shoe sole and laid flat such that the inside 92 of the strap is shown. The inside 92 of the strap is defined as the surface of the strap directed inwardly when the strap 90 is properly assembled with the sole and the opposed ends are joined. The strap 90 is preferably formed of a flexible web or body of material. As illustrated, the body of material is generally planer, but may be flexed to form different shapes. The strap 90 may be defined as having a pair of end portions 94 and 96 with a mid-portion 98 therebetween. Some type of closure member is provided for joining the opposed end portions 94 and 96 to one another. In the illustrated embodiment, a hook and loop type fastener material is provided at the outermost ends 100 and 102 of the end portions 94 and 96 respectively. One portion of the material is provided on the inside of one of the ends and the corresponding portion of the hook and loop type fastener material is provided on the outside of the other end so that when the ends 100 and 102 are joined using the closure member, the strap forms a loop.

As illustrated, the strap 90 is not just a straight, symmetrical belt of material. Instead, the strap 90 preferably has a shape configured to work most optimally as part of the present invention. The mid-portion 98 of the strap 90 may be said to have a first straight edge portion 104 at the front edge of the strap 90 and a second straight edge portion 106 at the rear edge of the mid-portion 98. As shown, the rear straight edge portion 106 may be longer than the front straight edge portion 104. The edge portions 104 and 106 are spaced apart and generally parallel to one another. The mid-portion 98 of the strap is designed to fit into the slot in the sole and the parallel edge portions are disposed in the slot. As discussed previously, the slot preferably has parallel front and rear edges. Preferably, the mid-portion 98 of the strap is a snug or slip fit into the slot. Alternatively, the strap may fit more loosely into the slot. In embodiments where the strap is a snug or slip fit into the slot, the slot and strap have similar dimensions. In some embodiments, the strap may have a slightly wider midportion than the width of the slot so as to provide a snug fit. The mid-portion 98 of the strap 90 may be defined as having a centerline 108 defined midway between the front and rear edges 104 and 106 and generally parallel thereto. The strap 90 may be defined as having a longitudinal axis extending end-to-end and a transverse axis extending front-to-rear. The centerline 108 is therefore a longitudinal axis of the mid-portion 98.

One of the end portions 94 has a section that is somewhat transversely narrower than the mid-portion 98. The other end portion 96 is somewhat angled with respect to the mid-portion 98. Specifically, the end portion 96 may be defined as having a centerline 110 that is midway between its front and rear edges. The centerline 110 of the end portion 96 is angled with respect to the centerline 108 of the midportion 98. In the illustrated embodiment, the inside angle C between the line 108 and 110 is approximately 15 degrees. In other embodiments, the angle may be different, such as in the range of 10–20 degrees.

When the opposed ends 100 and 102 of the strap 90 are joined to one another, the strap forms a tapered loop due to its shape. By tapered loop, it is meant that the strap forms a loop that has a front opening that is somewhat smaller than its rear opening. This shape is preferred to comfortably fit about a foot. Strap shapes other than illustrated may be used with shoes according to the present invention, or with the illustrated soles. Also, other strap designs may be used that provide a tapered loop when the ends are joined.

The strap 90 illustrated in FIG. 16 is one size and design of strap that may be used with the previously discussed soles. For use with a woman's size 6 medium, the strap may have a length of approximately 12⅜ of an inch and a front to rear width of approximately 3⁵⁄₁₆ of an inch in the midportion. The end portions 94 and 96 may be somewhat narrower than the midportion. In the illustrated embodiment, the end portion 94 has a front to rear width at its outermost end 100 of approximately 2½ of an inch and the end portion 96 has a front to rear width as its outermost end 102 of 2⅝ of an inch.

Figure 17:
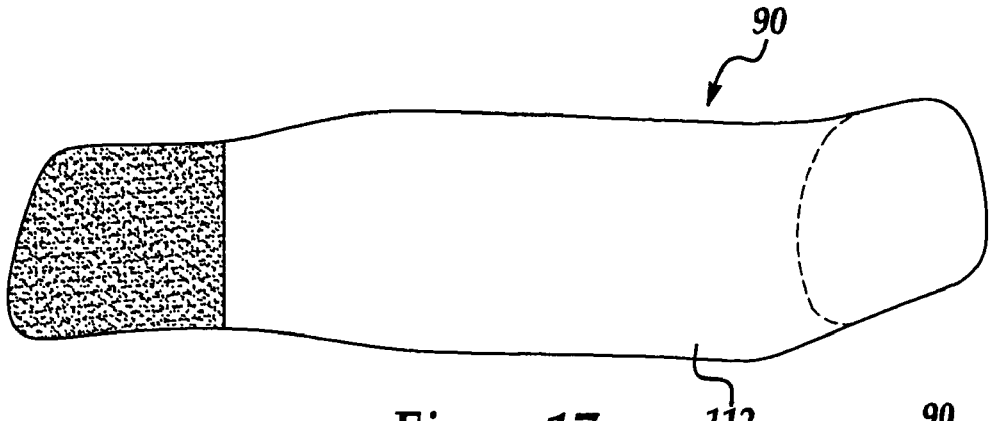
FIG. 17 is a bottom plan view of the strap of FIG. 16.
Figure 18:
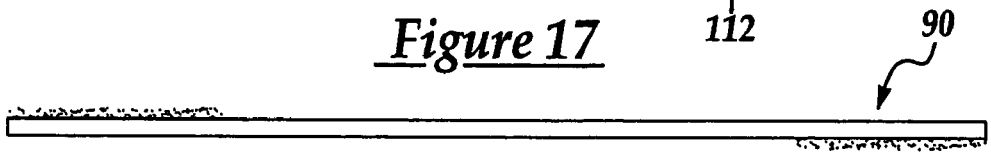
FIG. 18 is a side elevational view of the strap of FIG. 16, the opposite side view being a mirror image thereof.
Figure 19:
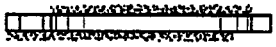
FIG. 19 is an elevational view of one end of the strap of FIG. 16.
Figure 20:
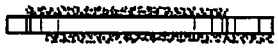
FIG. 20 is an elevational view of the other end of the strap of FIG. 16.
Figure 21:
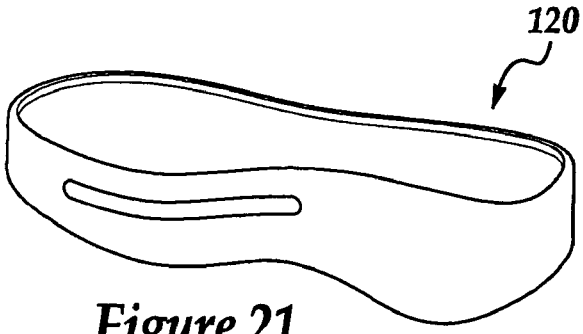
FIG. 21 is a perspective view of a third embodiment of a shoe sole for use with the present invention.
Figure 22:
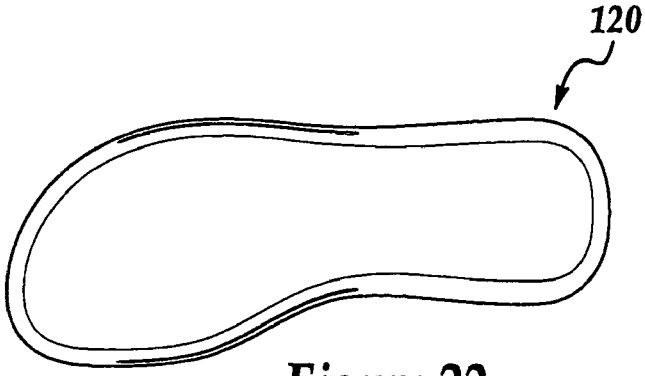
FIG. 22 is a top plan view of the shoe sole of FIG. 21.
Figure 23:
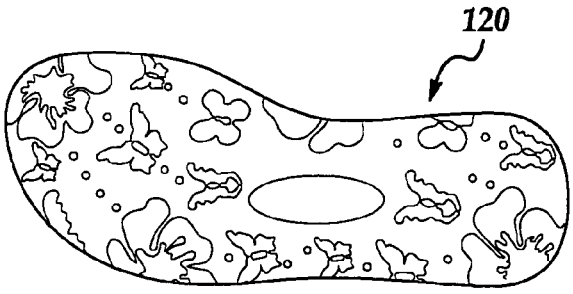
FIG. 23 is a bottom plan view of the shoe sole of FIG. 21.
Figure 24:
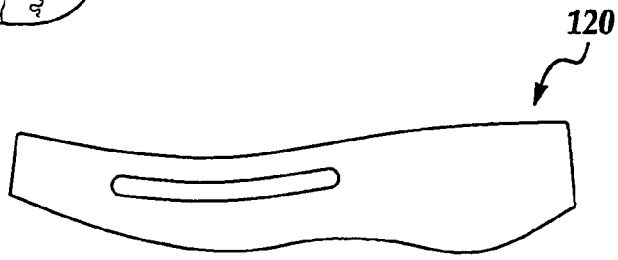
FIG. 24 is a side elevational view of the shoe sole of FIG. 21, the opposite side being a mirror image thereof.
Figure 25:
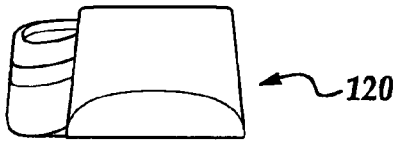
FIG. 25 is a rear elevational view of the shoe sole of FIG. 21.
Figure 26:
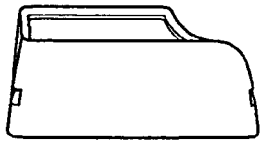
FIG. 26 is a front elevational view of the shoe sole of FIG. 21.
Figure 27:
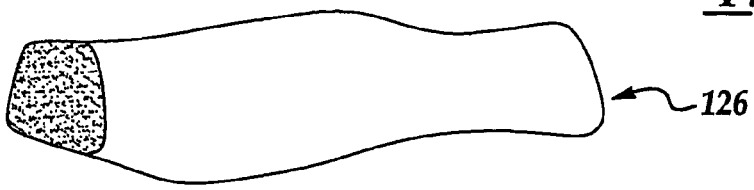
FIG. 27 is a top plan view of a strap for use with the shoe sole of FIGS. 21–26.
Figure 28:
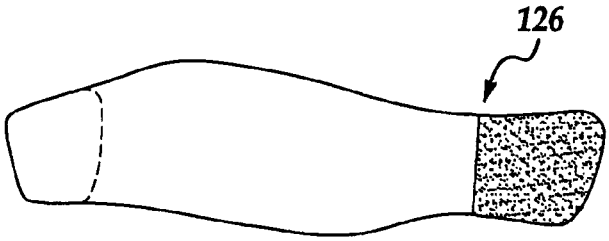
FIG. 28 is a bottom plan view of the strap of FIG. 27.
Figure 29:
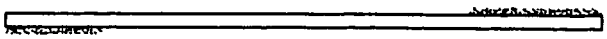
FIG. 29 is a side elevational view of the strap of FIG. 27, the opposite side being a mirror image thereof.
Figure 30:
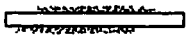
FIG. 30 is an elevational view of one end of the strap of FIG. 27.
Figure 31:
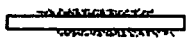
FIG. 31 is an elevational view of the other end of the strap of FIG. 27.

Referring now to FIG. 17, the outside 112 of the strap 90 may be seen. Preferably, the outside of the strap 112 has a decorative design that is visible once the shoe is assembled. The designs which may be provided on the outside surface 112 are widely varied. Many different materials may used to form a strap, as long as the material has sufficient strength to reliably retain the shoe on a user's foot. Examples of materials which may be used to form the straps include fabrics, vinyls, leather, die-stamped thermoplastic or rubber, and others. Examples of finishes include a variety of fabric finishes, a wide variety of colors, various surface finishes, such as sequins and coatings, and finishes that simulate other materials, such as wood. A wide variety of other materials and appearances may be used. As will be clear to those of skill in the art, the strap as illustrated is for use on one shoe, with a mirror image of the strap being used for the other shoe in a pair. Identical straps may be provided for each shoe if the straps are provided with the same finish and appearance on the inside and outside surfaces. Alternatively, a pair of straps may have different finishes on the inside and outside such that the straps can be traded from right to left and left to right to trade between the inside and outside finishes on the straps. That is, if a strap is moved from one shoe to the other, it may be reversed such that its inside surface becomes its outside surface and its outside surface becomes its inside surface. Alternatively, the inside surface may be formed of a material or given a finish that enhances the comfort of the shoe, and is not designed to be visible. Closure members other than hook and loop type fastener material may be used to join the ends of the straps. For example, a buckle, laces, hooks or snaps may be provided on the opposed ends of the strap to join the ends to one another. Other closure members may also be used. The strap 18 may be come in various thicknesses. FIG. 18 is a side view and shows the thickness of the strap. In some preferred embodiments, the strap has a thickness in the range of two to four millimeters.

Obviously, strap length helps to determine the width and fit of the shoe. Some types of closure members, such as laces and hook and loop type fastening material allow for some range of adjustment in the effective size of the loop formed by the strap. In some embodiments, the straps may be provided in a single length for use with multiple sizes of shoes. Alternatively, a wide variety of strap lengths may be provided. In one approach, approximately three different strap lengths are provided so as to provide an adequate range of fit for typical adult shoe sizes and widths. Particular strap lengths may not be tied to particular sole sizes since a person with a shorter but wider foot may need a longer strap than a person with a longer but narrower foot.

The illustrated designs of soles and straps provide a shoe design wherein the strap and shoe sole cooperate to form a shoe upper. For purposes of the present invention, a shoe upper is defined as the portions of a shoe that contact a user's foot. A shoe upper also functions to retain the shoe on the user's foot. The shape, positioning and width of the strap help to allow the strap and sole to cooperate to function as a shoe upper. As mentioned previously, the slot in the sole of a shoe according to the present invention may be generally aligned with the ball break line of the sole such that a strap engaging the slot straddles the ball break line of the sole and of the foot. This positioning reliable secures the shoe to the foot such that it does not easily move forwardly or backwardly with respect to the foot.

Referring now to FIGS. 21–26, an additional embodiment of a shoe sole 120 according to the present invention is illustrated. The illustrated shoe sole 120 is designed as a child's shoe sole, though may be scaled up and used as an adult shoe sole. This shoe sole is a more level or flat design, wherein the upper surface 122 is less angled with respect to the lower surface 124. In some embodiments wherein the shoe sole is more of a flat design, such as shown in FIGS. 21–26, the slot may be perpendicular or closer to perpendicular to the heel-toe line than previously discussed. Also, a different shaped strap 126 as shown in FIGS. 27–31 may be used with the child's shoe sole design of FIGS. 21–26.

Figure 32:
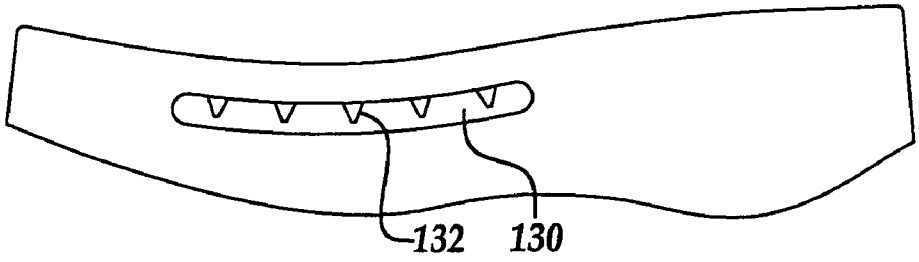
FIG. 32 is a side elevational view of a shoe sole with an alternative slot configuration having auxiliary retention means therein.

Referring now to FIG. 32, a sole with an alternative slot 130 is shown. The slot previously discussed had smooth upper and lower surfaces. The slot 130 of FIG. 32 has projections or nubs 132 on its upper side to secure the strap in position. The nubs or projections 132 may be formed with any of a variety of materials. Various widths of straps may be used, especially with the slot 130 of FIG. 32. In some embodiments, the straps may have a cross-section with ridges. The ridges may be of different shapes and designs so as to interlock with the nubs or projections 132 of slot 130. Alternatively, other gripping means may be provided within the slot 130, such as hook and loop fastener, or nubs or projections may be also provided in the lower surface. The nubs or projections 132 allow straps narrower than the length of the slot to be positioned and held in place by the projections or nubs. The projections or nubs may extend the full width of the shoe or may be arranged in other ways. Multiple narrow straps may pass through the slot 130 or the earlier slot and used in parallel, or in some type of criss-crossing or woven pattern. The nubs or projections help to hold the individual straps in position in the slot. As will be clear to those of skill in the art, the slot in the sole may be somewhat compressed when the weight of a foot is on it. This helps to hold the straps in position. Texture or interconnecting tabs on the straps may also assist.

As additional alternatives, some type of locking device may be provided for insertion into the slot once the strap is in place. For example, a thin, flat piece of material could be slid into the slot once the straps are in place to hold the straps in position. As another alternative, a long strap may be passed through the slot and then passed around the foot and/or ankle and tied into position. Also, multiple slots may be provided in various positions along the platform to provide straps in a wider variety of positions. Slots not being used may be filled with a filler, which may double as a locking member for straps.

Figure 33:
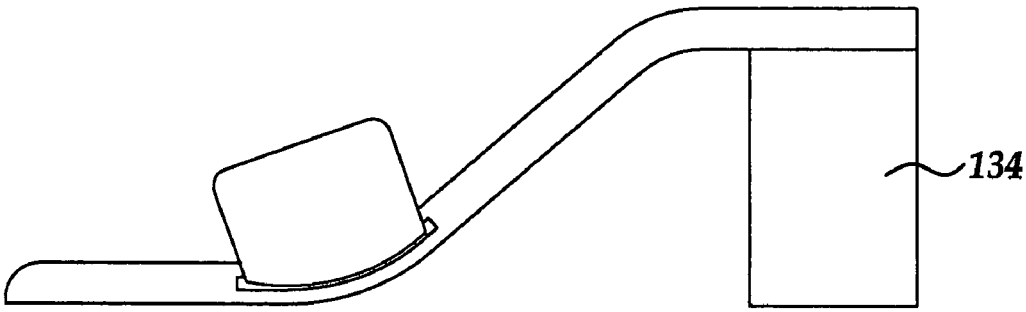
FIG. 33 is a side elevational view of an alternative shoe configuration according to the present invention.
Figure 34:
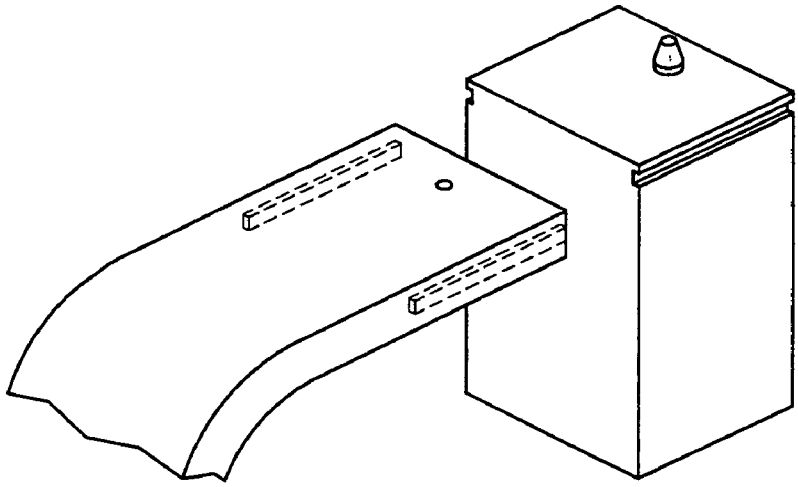
FIG. 34 is an exploded view of the portions of a shoe design with an interchangeable heel portion.
Figure 35:
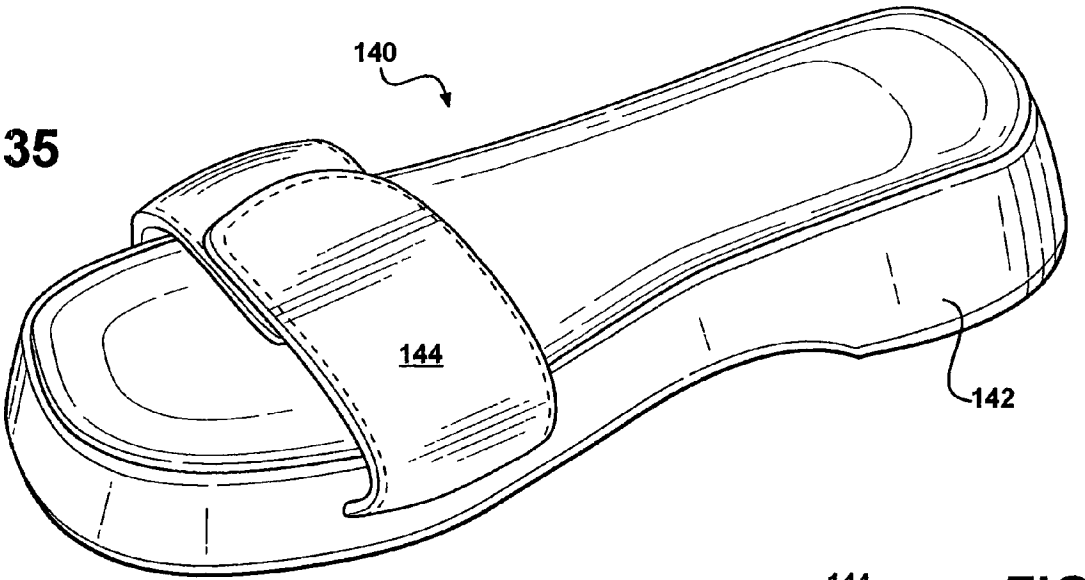
FIG. 35 is a perspective view of another embodiment of the shoe according to the present invention with the opposed ends of an interchangeable strap interconnected to form the shoe's upper.
Figure 36:
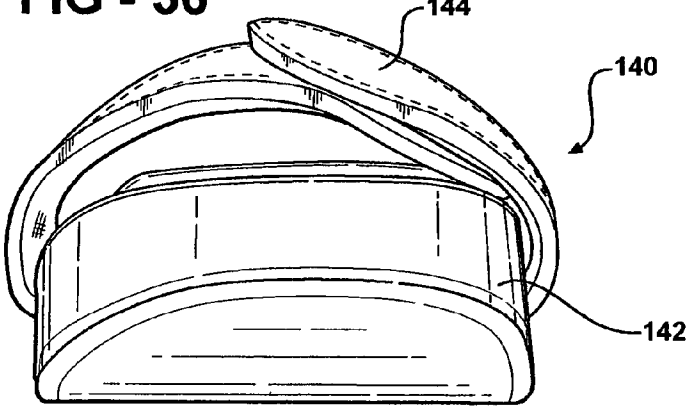
FIG. 36 is a front view of the shoe of FIG. 35.
Figure 37:
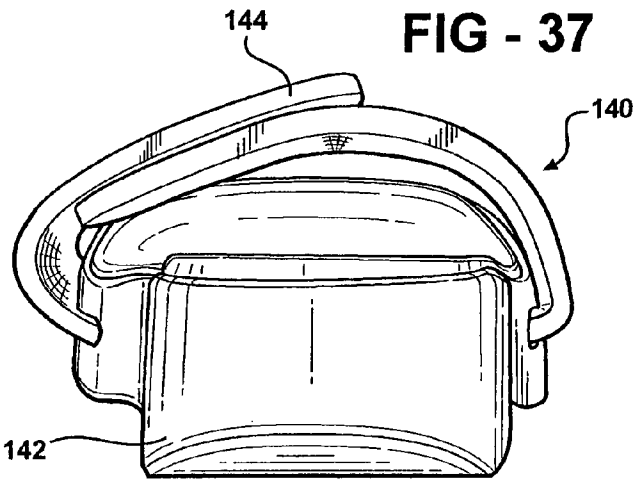
FIG. 37 is a rear view of the shoe of FIG. 35.
Figure 38:
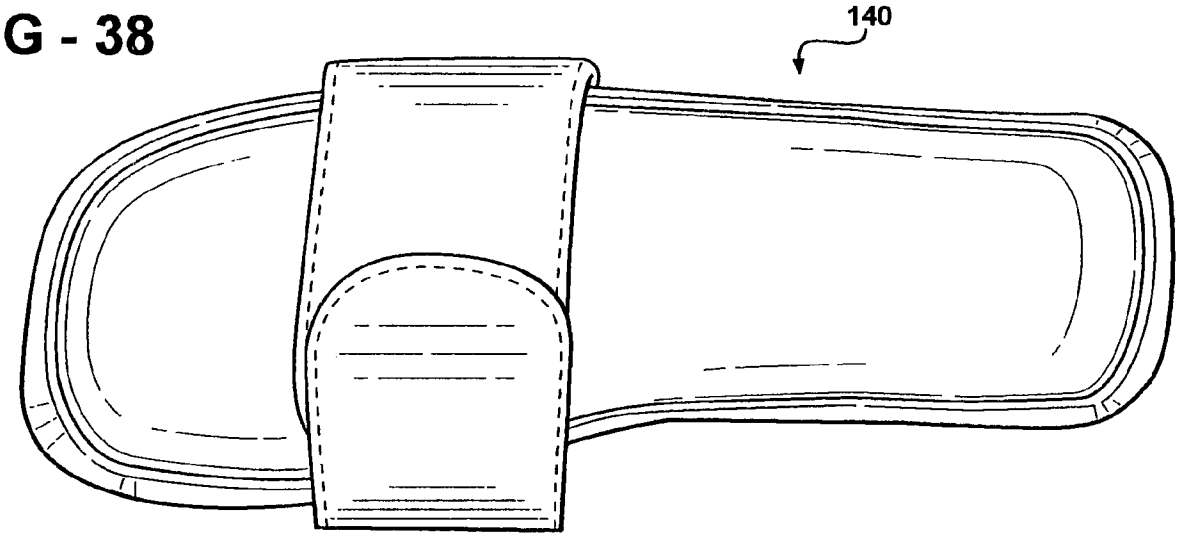
FIG. 38 is a top plan view of the shoe of FIG. 35.
Figure 39:
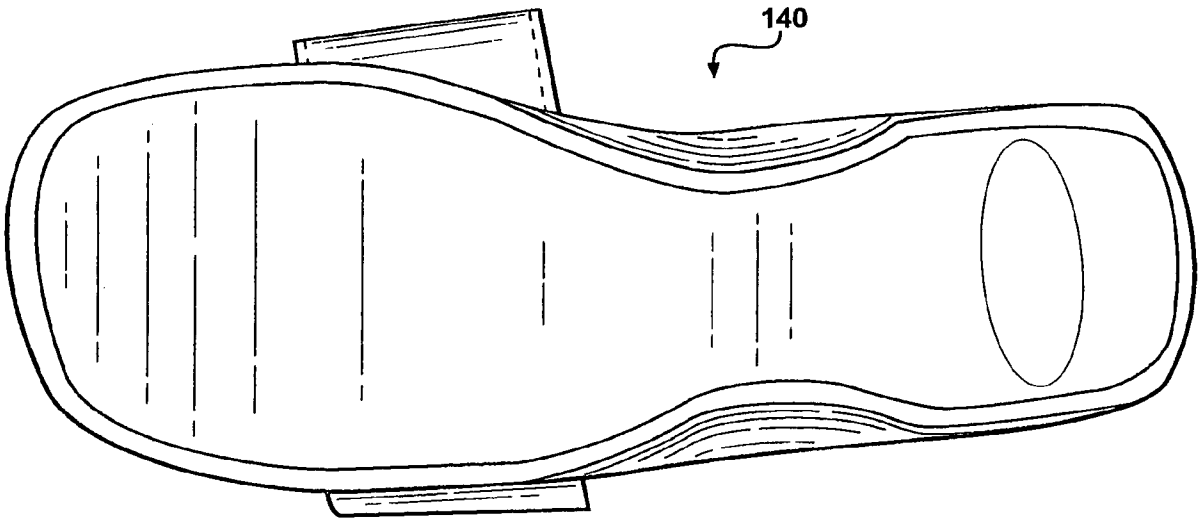
FIG. 39 is a bottom view of the shoe of FIG. 35.
Figure 40:
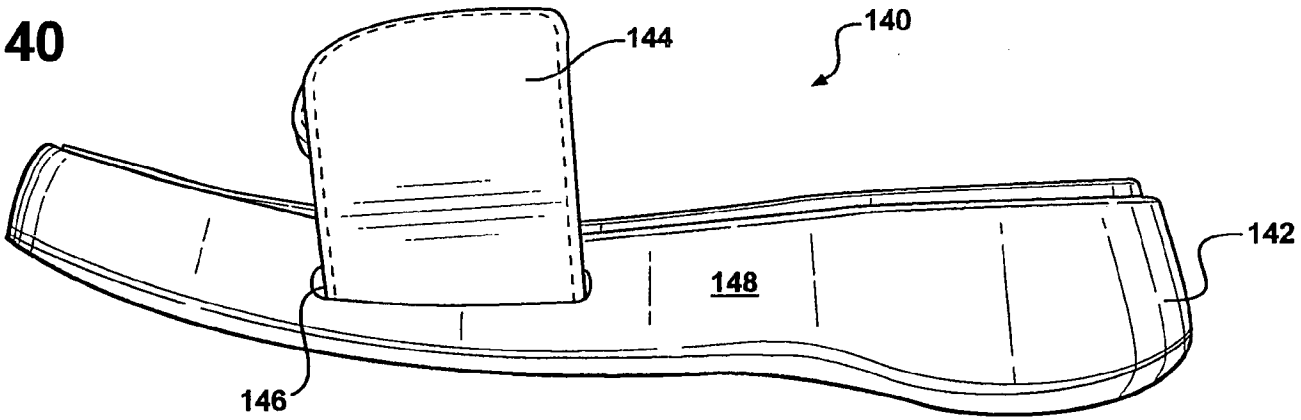
FIG. 40 is a first side view of the shoe of FIG. 35.
Figure 41:
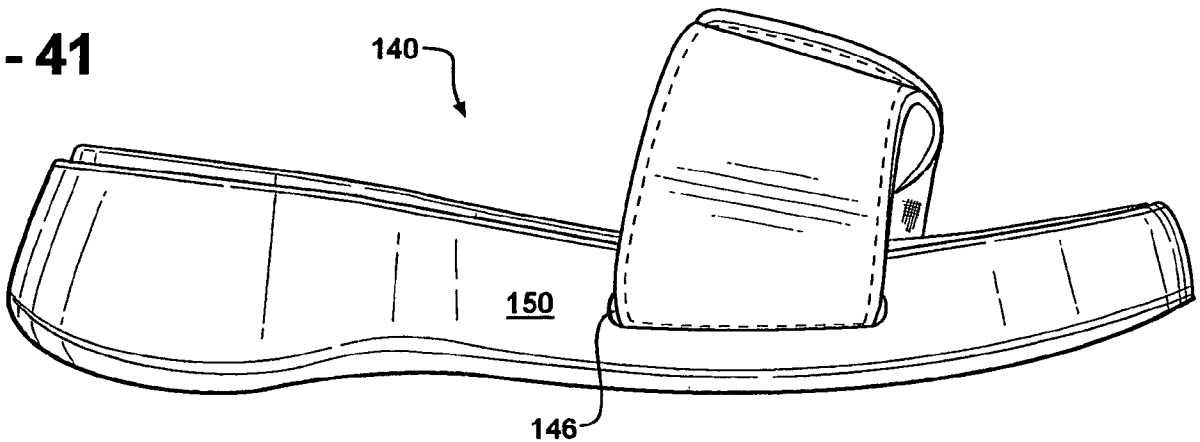
FIG. 41 is an opposite side view of the shoe of FIG. 35.

FIG. 33 shows another shoe design having a higher heel and a more traditional heel design. As a further alternative, any of the soles thus far disclosed may also include covering material for the sides of the sole with a covering material being interchangeable to vary the aesthetics of the sandal. This is especially applicable in the design of FIG. 33 wherein the heel 134 may have interchangeable covering material. The covering material may be attached with any of a variety of attachment methods, including hook and loop fastening material. Covering may also be provided on the sides of the sole other than the heel. Provision may also be made for interchangeable heels. For example, the bottom of the sole of the platform may have a male or female track with a corresponding heel having a corresponding track for interlocking with the platform. One approach to this is shown in FIG. 34.

Referring now to FIGS. 35–41, an additional embodiment of a shoe according to the present invention is generally shown at 140. The shoe includes a sole member 142 and a strap 144. The sole member 142 has a slot 146 (FIGS. 40 and 41) that extends side-to-side through the sole member from a first side wall 148 to a second side wall 150.

Figure 42:
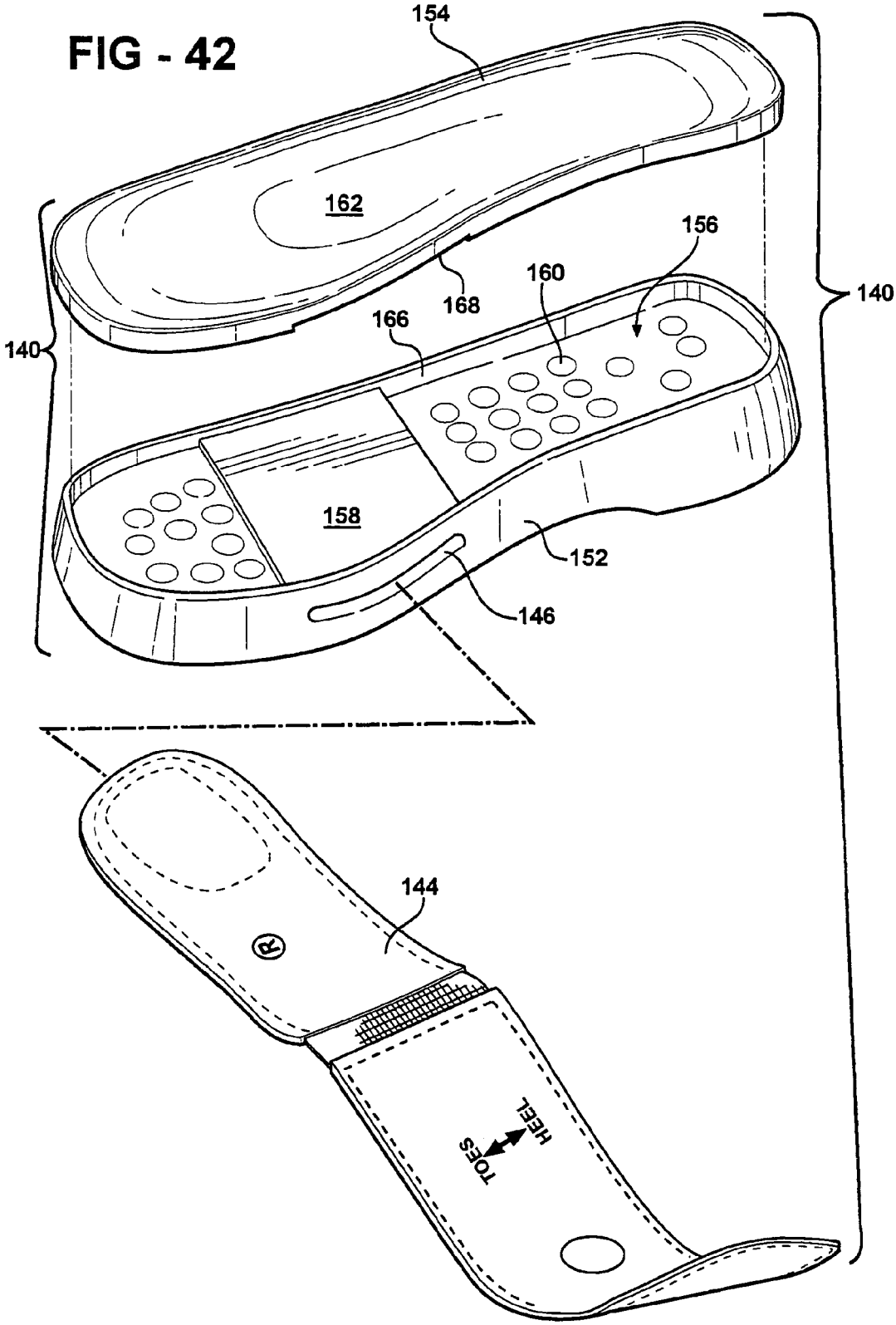
FIG. 42 is an exploded view of the shoe of FIG. 35 with the inner sole portion removed from the remainder of the sole, and the strap removed from the slot.

An exploded view of one version of the shoe 140 is shown in FIG. 42. As will be clear to those of skill in the art, the shoe 140 may be constructed in ways other than illustrated in FIG. 42, with FIG. 42 representing the preferred approach. As shown, the sole member 142 includes a lower or outer sole portion 152 and a foot bed or inner sole portion 154. The foot bed 154 is received in a concave recess 156 on the upper side of the outer sole 152. As shown, the concave recess 156 has a generally flat bottom with a raised section 158 above the slot 146. This raised portion 158 provides for additional material above the slot 146 so as to reinforce it. As with early embodiments, a reinforcement member may be embedded in the outer sole 152 to further reinforce the slot. However, in a preferred embodiment, the reinforcement member is not necessary. As also shown, the recessed area 156 has a plurality of openings 160 that extend downwardly into the outer sole 156. These openings reduce the amount of material required to create the outer sole, and increase the compliance of the outer sole, and may provide benefits in molding the outer sole. The foot bed preferably has a concave upper surface 162 for receiving a foot. A cross-section of the shoe 140 taken at the center line of the slot 146 is provided in FIG. 43. The relationship of the slot 146, outer sole 152, and foot bed 154 is shown. In one preferred embodiment of the present invention, the foot bed 154 is formed of a soft, resilient foam and is covered on its upper and side surfaces with a covering material, such as a synthetic leather. This covering material would cover the concave upper surface 162 and extend downwardly along the sides 164 so as to be trapped between the perimeter wall 166 of the outer sole and the outer wall or side wall 164 of the inner sole 154. The covering material may further extend so as to be trapped between the underside of the foot bed and the upper surface of the outer sole 152.

As best shown in FIG. 42, the lower surface 168 of the foot bed 154 has a portion that is notched upwardly so as to compensate for the raised portion 158 of the outer sole 152.

Figure 44:
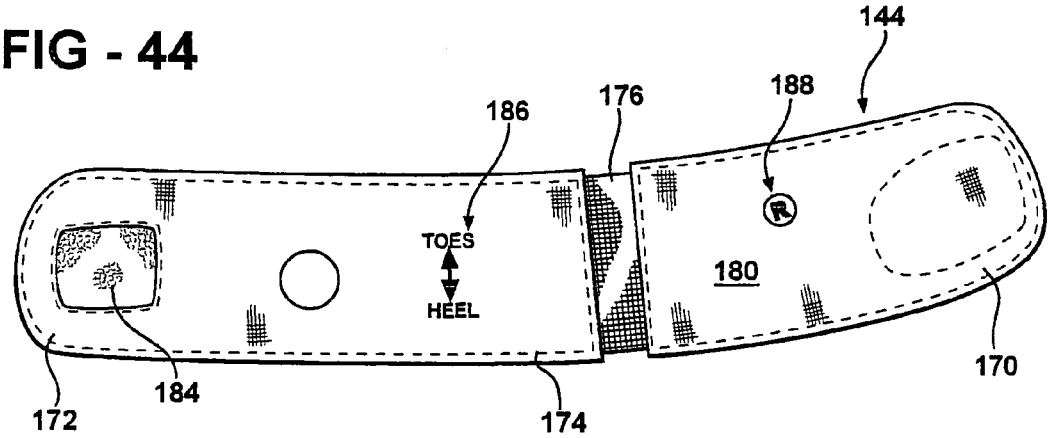
FIG. 44 is a plan view of the preferred embodiment of the strap for use with the shoe of FIG. 35 showing the inner surface thereof.
Figure 45:
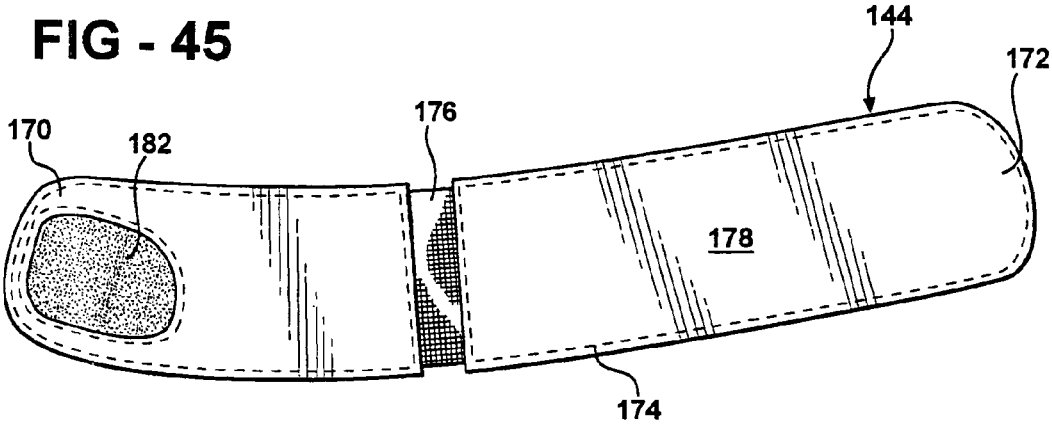
FIG. 45 is a plan view of the strap of FIG. 44, showing the outer surface thereof.
Figure 46:
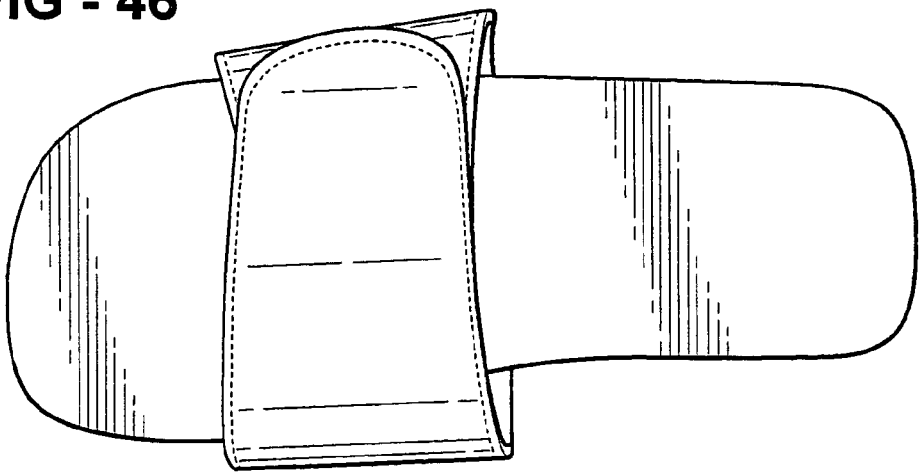
FIG. 46 is a top view of yet another embodiment of a shoe according to the present invention.
Figure 47:
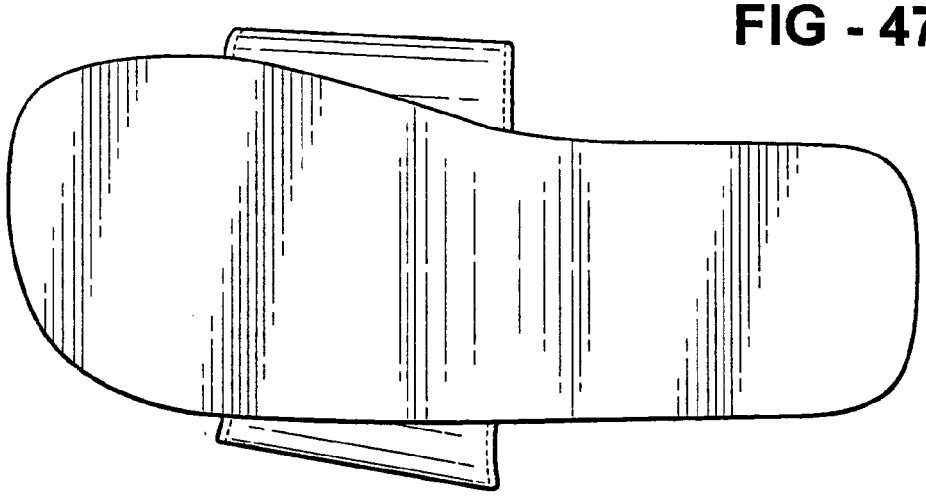
FIG. 47 is a bottom view of the shoe of FIG. 46.
Figure 48:
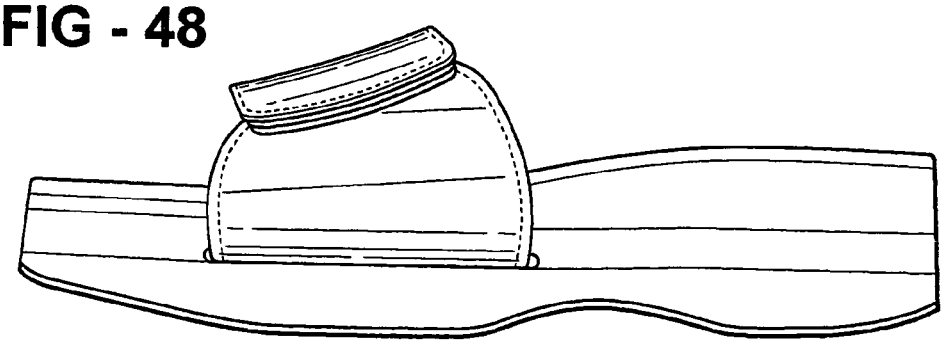
FIG. 48 is a side view of the shoe of FIG. 46.

Referring to FIGS. 44 and 45, the strap 144 has a pair of opposed ends or end portions 170 and 172 with a mid-portion extending therebetween. In this embodiment, the mid-portion 174 preferably includes an elastic section 176 that allows the distance between the opposed ends 170 and 172 to be increased by stretching the elastic section 176. By "elastic," it is meant that the section 176 can be stretched and is resilient that it returns generally to the same size as before it was stretched. The elastic section allows the strap 144 to be somewhat stretchable such that it flexes while a user walks, and also allows the strap to better fit a range of sizes. As will be clear to those of skill in the art, this embodiment of the shoe may also be constructed with a strap that does not have an elastic section. Further, the elastic section may be constructed other than is indicated, such as on a different part of the strap, or by making a larger portion of the strap stretchable. In this preferred embodiment, the elastic section 176 is a portion of elastic material that is sewn to the remainder of the strap, which is preferably at least partially formed of a vinyl or cloth material. For example, the outer surface 178 may be a vinyl or cloth material with an appearance to be seen when the shoe is worn. The inner surface 180 may be a softer, cloth-like material for comfort purposes, while the inner and outer surfaces may be separated by a thin cushioning layer.

Figure 43:
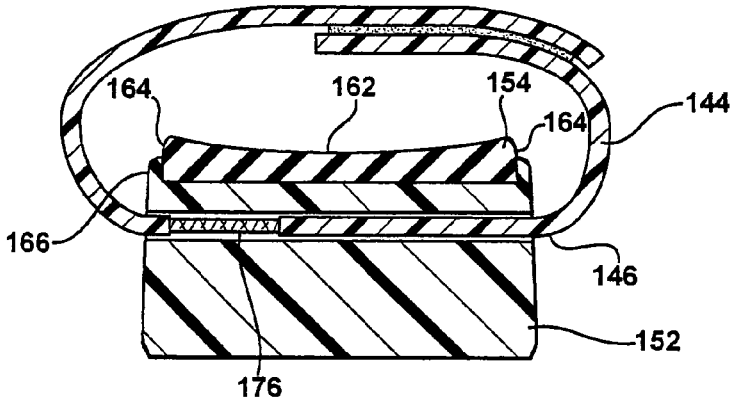
FIG. 43 is a cross-sectional view of the strap and sole.

In use, the strap 144 is preferably positioned such that the elastic section 176 is disposed in the slot 146, as best shown in FIG. 43. This allows the elastic section to be generally hidden in use. The ends or end portions preferably include portions of hook and loop-type fastener material 182 and 184. As shown, one portion 182 is disposed on or in the outer surface 178 while the other portion 184 is disposed on or in the inner surface 180. It is preferred that the portion 184 facing the inner surface of the shoe is the loop part of the hook and loop-type fastener material so as to provide a softer feel. As shown, it is preferred that the portion 184 be positioned in a cut-out in the inner surface so as to reduce the overall thickness of the strap. The corresponding portion 182 may be attached to the outer surface 178, or may also be recessed. It is preferred that the portion 182 of hook and loop-type fastener material on the outer surface 178 have a front-to-back width less than the overall width of the strap 144. This allows the fastener material to be less visible if the ends 170 and 172 of the strap are not perfectly aligned when they are interconnected. As best shown in FIGS. 44 and 45, it is preferred that the strap 144 have a front-to-back width that is generally constant across its length. However, versions of the strap may be constructed that have wider and narrower portions. As with prior embodiments, it is preferred that when the ends or end portions are joined, the strap forms a tapered loop with a larger rear opening than front opening.

It should be appreciated that FIGS. 35–45 illustrate the shoes or shoe components that are for a right foot, with a corresponding left foot preferably also provided. The shoe and shoe components are preferably a mirror image for the left foot. As best shown in FIGS. 42 and 44, the inner surface of the strap 144 preferably has indicia 186 for indicating which edge of the strap 144 is directed towards the front of the shoe and which is directed towards the rear. In this embodiment, a labeled double-headed arrow points towards the toe and heel of the shoe. Additionally, indicia 188 is provided for indicating whether the strap is for a right or left shoe.

As will be clear to those of skill in the art, the strap 144 may be constructed of various materials. Preferably, the elastic section 176 is formed of an elastic material, while the remainder of the strap is formed of a generally non-elastic material. The elastic section 176 preferably has a side-to-side length less than one inch when not stretched and less than two inches when stretched. Additional aspects of the sole member 142 and strap 144 are similar to earlier embodiments. For example, the slot preferably has an upper and lower limit interconnected by a front and rear edges, with the edges being preferably parallel and spaced apart by greater than two inches. Also, the upper limit of the slot 146 preferably follows the contour of the upper surface of the sole member 142. The strap 144 is preferably self-supporting, as best shown in FIG. 43, such that the opposed ends are supported above the foot bed when they are joined. The outer sole 152 may be formed of a variety of materials, including injection-molded from a polymeric material.

Turning now to FIGS. 46–51, yet another embodiment of a shoe according to the present invention is shown. This embodiment is similar to prior embodiments, except that the sole is preferably formed of a stack of foam polymeric material layers that are each stamped to shape. The layers are then stacked together and bonded to form the final shoe sole member. The stacking of layers allows each layer to have a different color, if desired, leading to a distinctive appearance. The strap for use with this embodiment is similar to prior embodiments. However, it preferably does not include an elastic section, but is otherwise shaped similar to the strap 144. It may be formed of a material that is somewhat elastic so as to provide a function similar to the strap 144, or may be formed of a non-elastic material. The sole member is simpler than in the previous embodiment, since it preferably does not include a foot bed formed of a softer and shaped material. Instead, it is formed of a material similar to a "flip-flop" type sandal and may conform to the user's foot over time.

Numerous alternative designs of shoes with interchangeable straps or uppers fall within the scope of the present invention. While in the illustrated preferred embodiments, each shoe is illustrated as having a single slot for use with a single strap, designs may also be provided wherein two or more slots may be provided in the sole. A single strap may be used which is placed in one of the available slots, or multiple straps may be provided with one strap engaging each slot. For example, instead of providing a single strap that bridges the ball break line, one strap may be provided ahead of the ball break line and a second one may be provided behind the ball break line. Multiple straps may also be provided in different relationships to the ball break line. As yet a further example, a high heel version of a shoe according to the present invention may include a second strap that engages a foot above the arch or nearer to the ankle for styling and/or functional reasons.

The illustrated embodiments disclose the use of a single strap. However, additional straps may be provided with more than one strap engaging a single slot. For example, a wide slot may have room for two or more straps side-by-side. Alternatively, straps may be stacked on top of each other with more than one strap engaging the foot.

The straps as previously discussed each include closure members for joining the opposed ends of the strap to one another. As an alternative, a strap may be provided that is sufficiently flexible and elongated to allow the ends to be tied to each other, as would be done with a lace or scarf.

As will be clear to those of skill in the art, the preferred embodiments of the present invention may be altered in various ways without departing from the scope or teaching of the present invention. For example, the slot extending through the sole may be altered in various ways. The slot may be curved side-to-side, front to back, or up to down as it passes through the sole. The slot may have a different cross section than illustrated, such as oval, round, diamond-shaped, or others. The slot may also have entrances and/or exits in the upper surface of the sole to allow the strap to conform more closely to the foot. Along these lines, the slot may taper upwardly near the sides to more closely conform the strap to the foot. That is, near the edges, the slot may curve upwardly or taper upwardly so as to bring the slot entrance or exit nearer to the upper surface.

The shoe sole and strap drawings provided herein are scale drawings of some embodiments of the present invention. Therefore, sizes of various elements, and ratios and relationships, may be determined for these embodiments by measuring the corresponding elements in the drawings. However, the present invention is not limited to the embodiments illustrated, or the measurements or ratios attainable from the drawings.

We claim:

1. A method of making universally adjustable interchangeable footwear, said method comprising the steps of:

forming a unitary sole member having an upper surface configured to receive a foot and a lower surface configured to contact a support surface, said sole member further having a first sidewall, a second sidewall spaced from said first side wall, and at least one slot extending between said first and said second side walls of said unitary sole member, said side walls extending between said upper surface and said lower surface and the slot being spaced from said upper surface and said lower surface of said unitary sole member;

providing at least one strap member, said at least one strap member having opposed ends and a mid-portion therebetween the mid portion of the strap member further includes an elastic section that allows the distance between the opposed ends to be increased by stretching the elastic section, each of said at least one strap member having a hook type fastener material provided on a portion of one of said opposed ends and a loop type fastener material on the other portion of said opposed ends; and inserting said at least one strap member through said at least one slot in said sole member such that said mid-portion is located in said slot;

whereby when a person positions a foot on said upper surface of said sole member and said opposed ends of said at least one strap member are overlapped said hook type fastener material on said one portion of said opposed ends is securely fastened to said loop type fastener material on said other portion of said opposed ends to conform said at least one strap member to the foot and securely attach said sole member to the foot independent of the size of the foot;

wherein the elastic section remains hidden in the slot even after being stretched wherein said at least one strap member is the only portion of the footwear extending above said upper surface of said sole member for attaching said sole member to the foot.

2. The method of claim 1, wherein:

said at least one strap member comprises a first strap member and a second strap member and the inserting step comprises inserting said first strap member, the method further comprising;

separating the joined ends of said first strap member and removing said strap member from said at least one slot;

inserting said second strap member thru said at least one slot in said sole member such that said mid-portion is located in said at least one slot;

whereby when a person positions a foot on said upper surface of said sole member and said opposed ends of said second strap member are overlapped said hook type fastener material on said one portion of said opposed ends is securely fastened to said loop type fastener material on said other portion of said opposed ends to conform said second strap member to said foot and securely attach said sole member to said foot independent of the size of the foot.

3. The method of claim 1, wherein:

when said opposed ends of said at least one strap member are overlapped and fastened, said strap member forms a tapered loop with a forward opening smaller than a rearward opening.

4. A method of making universally adjustable interchangeable footwear offering a plurality of appearances, the method comprising:

forming a unitary sole member having an upper surface configured to receive a foot and a lower surface configured to contact a support surface, said sole member further having a first sidewall, a second sidewall spaced from said first side wall, and at least one slot extending between said first and said second side walls of said unitary sole member, said side walls extending between said upper surface and said lower surface and the slot being spaced from said upper surface and said lower surface of said unitary sole member;

providing a first strap member having opposed ends and a mid-portion therebetween, said first strap member having a hook type fastener material provided on a portion of one of said opposed ends and a loop type fastener material on the other portion of said opposed ends;

inserting said first strap member through said at least one slot in said sole member such that said mid-portion is located in said slot;

whereby when a person positions a foot on said upper surface of said sole member and said opposed ends of said first strap member are overlapped said hook type fastener material on said one portion of said opposed ends is securely fastened to said loop type fastener material on said other portion of said opposed ends to conform said first strap member to the foot and securely attach said sole member to the foot independent of the size of the foot, said first strap member and said sole member forming a first footwear version wherein said first strap member is the only portion of the footwear extending above said upper surface of said sole member for attaching said sole member to the foot;

providing a second strap member having opposed ends and a mid-portion therebetween, said second strap member having a hook type fastener material provided on a portion of one of said opposed ends and a loop type fastener material on the other portion of said opposed ends, said second strap member having an appearance different from the first strap;

removing said first strap member from said at least one slot;

inserting said second strap member through said at least one slot in said sole member such that said mid-portion is located in said slot;

whereby when a person positions a foot on said upper surface of said sole member and said opposed ends of said second strap member are overlapped said hook type fastener material on said one portion of said opposed ends is securely fastened to said loop type fastener material on said other portion of said opposed ends to conform said first second member to the foot and securely attach said sole member to the foot independent of the size of the foot, said second strap member and said sole member form a second footwear version having an appearance different from said first footwear version wherein said second strap member is the only portion of the footwear extending above said upper surface of said sole member for attaching said sole member to the foot wherein the mid portion of each strap member includes an elastic section that allows the distance between the opposed ends to be increased by stretching the elastic section, and wherein each elastic section remains hidden in the slot even after being stretched.

5. The method of claim 1, wherein:

a majority of said strap member being formed of a generally non-elastic material.

* * * * *